US008902203B2

(12) United States Patent
Hsu et al.

(10) Patent No.: US 8,902,203 B2
(45) Date of Patent: Dec. 2, 2014

(54) LIQUID CRYSTAL DISPLAY AND PULSE ADJUSTMENT CIRCUIT THEREOF

(75) Inventors: Wen Fa Hsu, Hsinchu (TW); Chi Mao Hung, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 267 days.

(21) Appl. No.: 13/087,578

(22) Filed: Apr. 15, 2011

(65) Prior Publication Data

US 2011/0193833 A1 Aug. 11, 2011

Related U.S. Application Data

(62) Division of application No. 11/971,627, filed on Jan. 9, 2008, now abandoned.

(30) Foreign Application Priority Data

Mar. 15, 2007 (TW) ..... 96108866 A

(51) Int. Cl.
*G09G 3/36* (2006.01)

(52) U.S. Cl.
CPC ..... *G09G 3/3696* (2013.01); *G09G 3/3648* (2013.01); *G09G 3/3677* (2013.01); *G09G 2310/06* (2013.01); *G09G 2320/0219* (2013.01)
USPC ..... 345/204; 345/211; 345/87

(58) Field of Classification Search
USPC ..... 345/87–111, 204, 211–212
See application file for complete search history.

(56) References Cited

U.S. PATENT DOCUMENTS

| | | | | |
|---|---|---|---|---|
| 5,602,560 | A | 2/1997 | Ikeda | |
| 5,798,741 | A * | 8/1998 | Kajihara | 345/94 |
| 6,229,531 | B1 | 5/2001 | Nakajima et al. | |
| 6,473,077 | B1 * | 10/2002 | Takenaka et al. | 345/209 |
| 6,768,481 | B2 * | 7/2004 | Ozawa et al. | 345/87 |
| 7,173,588 | B2 * | 2/2007 | Katagawa et al. | 345/89 |
| 7,460,114 | B2 * | 12/2008 | Mizumaki | 345/204 |
| 7,551,157 | B2 * | 6/2009 | Tanaka et al. | 345/98 |
| 7,737,933 | B2 * | 6/2010 | Yamano et al. | 345/94 |
| 7,982,219 | B2 * | 7/2011 | Kuo et al. | 257/59 |
| 7,990,357 | B2 * | 8/2011 | Shin | 345/99 |
| 8,259,140 | B2 * | 9/2012 | Murayama | 345/691 |
| 8,289,251 | B2 * | 10/2012 | Tsubata | 345/87 |
| 8,294,654 | B2 * | 10/2012 | Jang | 345/96 |

(Continued)

FOREIGN PATENT DOCUMENTS

| | | | |
|---|---|---|---|
| CN | 1514293 | A | 7/2004 |
| GB | 2326013 | | 12/1998 |
| JP | 10-339863 | A | 12/1998 |

OTHER PUBLICATIONS

Chinese language Office Action dated Jun. 13, 2008.

*Primary Examiner* — Christopher E Leiby
(74) *Attorney, Agent, or Firm* — WPAT, PC; Justin King

(57) ABSTRACT

A liquid crystal display comprises a power supply, a pulse adjustment circuit, and a gate driver. The pulse adjustment circuit is connected between the power supply and the gate driver. The power supply provides power signals. The pulse adjustment circuit adjusts the plurality of pulses of the power signals or selects the appropriate voltage levels for the power signals to have cutting angles or enlarged amplitudes, whereby the influence of the feedthrough voltage on the thin film transistors of the driving circuit would be reduced so that the display quality of the liquid crystal display is improved.

13 Claims, 15 Drawing Sheets

(56) References Cited

U.S. PATENT DOCUMENTS

| | | | | |
|---|---|---|---|---|
| 8,405,595 | B2 * | 3/2013 | Cho | 345/94 |
| 2001/0033266 | A1 * | 10/2001 | Lee | 345/94 |
| 2002/0008688 | A1 * | 1/2002 | Yamamoto et al. | 345/98 |
| 2002/0027540 | A1 * | 3/2002 | Lee | 345/87 |
| 2002/0057237 | A1 * | 5/2002 | Lin et al. | 345/87 |
| 2003/0169223 | A1 * | 9/2003 | Lee et al. | 345/92 |
| 2004/0066363 | A1 * | 4/2004 | Yamano et al. | 345/98 |
| 2004/0125059 | A1 | 7/2004 | Lee | |
| 2004/0246245 | A1 * | 12/2004 | Yanagi et al. | 345/204 |
| 2005/0062706 | A1 * | 3/2005 | Mizumaki | 345/94 |
| 2005/0083319 | A1 * | 4/2005 | Kodate et al. | 345/204 |
| 2005/0259054 | A1 * | 11/2005 | Wu | 345/82 |
| 2006/0022928 | A1 * | 2/2006 | Kim et al. | 345/94 |
| 2006/0092109 | A1 | 5/2006 | Hsu et al. | |
| 2006/0103800 | A1 * | 5/2006 | Li et al. | 349/129 |
| 2006/0145964 | A1 * | 7/2006 | Park et al. | 345/76 |
| 2006/0152458 | A1 * | 7/2006 | Angele et al. | 345/90 |
| 2006/0187165 | A1 * | 8/2006 | Ono et al. | 345/94 |
| 2006/0202977 | A1 * | 9/2006 | Oh | 345/204 |
| 2007/0171170 | A1 * | 7/2007 | Moon | 345/94 |
| 2007/0229433 | A1 * | 10/2007 | Jang | 345/96 |
| 2008/0062210 | A1 * | 3/2008 | Kim | 345/691 |
| 2008/0074369 | A1 * | 3/2008 | Hsu | 345/88 |
| 2009/0160882 | A1 * | 6/2009 | Kiya et al. | 345/690 |
| 2009/0167746 | A1 * | 7/2009 | Yoon | 345/211 |
| 2009/0289884 | A1 * | 11/2009 | Yanagi et al. | 345/92 |
| 2010/0149157 | A1 * | 6/2010 | Shih et al. | 345/211 |
| 2010/0283714 | A1 * | 11/2010 | Cho et al. | 345/90 |

* cited by examiner

LIQUID CRYSTAL DISPLAY AND PULSE ADJUSTMENT CIRCUIT THEREOF

CROSS-REFERENCES TO RELATED APPLICATIONS

This application is a divisional of U.S. application Ser. No. 11/971,627, filed Jan. 9, 2008, which claims the benefit from the priority of Taiwan Patent Application No. 096108866 filed on Mar. 15, 2007, the disclosures of which are incorporated by reference herein in their entirety.

BACKGROUND OF THE INVENTION

1. Field of the Invention

The present invention relates to a liquid crystal display (LCD) and a pulse adjustment circuit thereof.

2. Descriptions of the Related Art

With the rapid development of consumer electronic technology, people are becoming accustomed to using various electronic products, such as electronic multimedia products. One key component of multimedia electronic products is the display. Since liquid crystal displays (LCDs) have properties such as radiation-free, low power consumption, a plane square shape, high resolution, and stable display quality, LCDs have gradually replaced the traditional cathode ray tube displays (CRT displays). Consequently, the LCD is widely used as a display panel of electronic products such as cellular phones, display screens, digital televisions, and notebooks.

Generally, the LCD display panels comprise a plurality pixels arranged in an array. The display panel further comprises an active matrix driving circuit for controlling the operations of each pixel of the display panel. Each pixel comprises a thin film transistor (TFT), which functions as a switch.

The conventional TFT has three terminals: the gate, source and drain. The gate and source/drain of the TFT of each pixel are coupled to a scan line and a data line, and the two lines are orthogonal to each other. The active matrix display panel comprises an active matrix driving circuit which comprises a plurality of scan lines and data lines thereby. The scan line is driven by a gate driver, which is used to provide a gate signal to an associated TFT. The data line is driven by a source driver, which is used to provide data signals to the pixels.

To reduce the cost and the dimension of the LCD, the industrial field provides a different driving technology, mainly, the multi-switch half source driving (MSHD) technology which effectively decreases the number of source drivers to half of those in the prior art. In the conventional driving method, the charge time is determined by the width of a gate clock (GCK). When adopting MSHD technology, the charging time is reduced by half and also reduced the source to half in comparison to the conventional one. FIG. 1A illustrates the circuit of the conventional MSHD technology, while FIG. 1B is the waveform chart of a gate driving signal. The gate driving signal comprises a first pulse 11, a second pulse 13, and a third pulse 15, which are repeated in order. The first pulse 11 has a longer duty cycle, while the second pulse 13 and the third pulse 15 have a shorter duty cycle.

In FIG. 1A subpixels A, B, C, D and E, are used to illustrate the principle of operation with respect to the MSHD circuit. The drains of some subpixels' TFTs are connected to the data line, while the gates of these subpixels' TFTs are connected to the scan lines $G_n$, $G_{n-1}$, and $G_{n+1}$. The sources are grounded via a liquid capacitance $C_{LC}$ and are connected to the drains of other subpixels. The sources of the subpixels A and C are connected to the drains of the subpixels B and D, respectively. The gates of the subpixels B and D are connected to scan lines $G_{n-1}$, and $G_n$, respectively. The sources of subpixels B and D are grounded after connecting with the liquid capacitances $C_{LC}$. In the direction parallel to the data lines, the subpixels A, C, and E are defined as odd pixels, while the subpixels B and D are defined as even pixels.

In FIG. 1B, GCK stands for the clock signal of the gate driving signal. The gate driving signal, comprising the first pulse 11, the second pulse 13, and the third pulse 15, requires two clock cycles of time. The positive edge of the first pulse 11 occurs at the same time with the positive edge of the clock, while the negative edge of the first pulse 11 occurs earlier than the negative edge of the clock. The positive edge of the second pulse 13 occurs at the same time with the positive edge of the next clock, while the negative edge of the second pulse 13 occurs earlier than the negative edge of the next clock. The positive edge of the third pulse 15 occurs at the same time with the negative edge of the next clock, while the negative edge of the third pulse 15 occurs earlier than the positive edge of a further next clock. The timings of both adjacent scan lines differ by one pulse cycle, which means that the positive edge of the second pulse 13 of the scan line $G_{n-1}$ and the positive edge of the first pulse 11 of the scan line $G_n$ occur at the same time, and so on.

The alphabets in the following table represent the subpixels which are turned on for writing, i.e. charging, a data voltage, and the bold, italicized, and underlined alphabets represent the subpixels to which the data lines the data voltages will be supplied. In FIG. 1B, when the timing is T1, the gate line $G_n$ and the gate line $G_{n-1}$ are turned on simultaneously, so the subpixels A, B and E are charged at the same time. However, the voltage charged by the data line is configured to supply the subpixel B and other subpixels, and the subpixels A and E will be written in with the right voltages at following timings.

Furthermore, when it is at the timing T1 to write the data onto the subpixel B via charging, the scan lines $G_n$ and $G_{n-1}$ should be at the high level. At this time, the signals that are inputted to the scan lines $G_n$ and $G_{n-1}$ are at the first pulse 11 and the second pulse 13, respectively. When it is at the timing T2 to write the data onto the subpixel E via charging, the scan line $G_{n-1}$ should be at the high level, and the signal that is inputted to the scan line $G_{n-1}$ is at the third pulse 15. By the same analogy, the third pulse is at the high level when the data voltage is charged onto the odd subpixels, while the first pulse 11 and the second pulse 13 are at the high level when charging the data voltage to the even subpixels. The data voltage is then written to the subpixels B, E, D, A and C in the sequence according to the timings of T1, T2, T3, T4, and T5.

| timing | T1 | T2 | T3 | T4 | T5 |
|---|---|---|---|---|---|
| Charged subpixel | A, ***B*** E | ***E*** | A, C, ***D*** | ***A*** | ***C*** |

However, the MSHD driving technology would make the feedthrough voltages of the two adjacent subpixels different, and result in the final voltage difference between the odd subpixels and the even subpixels due to the turn-on times of the TFTs 117 of the two adjacent subpixels are different, as shown in FIG. 1C. The TFTs 117 of the odd subpixel and even subpixel are both affected by the feedthrough voltages at one time. The voltage stored in the liquid crystal capacitances $C_{LC}$ of the even subpixels, however, is affected by the liquid crystal capacitances $C_{LC}$ of the odd subpixels when the charging of the odd subpixels has been stopped. The voltage stored in the liquid crystal capacitances $C_{LC}$ of the even subpixels is halved, while the other half of the voltage is provided to charge the liquid crystal capacitances $C_{LC}$ of the odd subpixels. In the end, the final voltages of the two adjacent subpixels are different, the charged data voltages in the subpixels are different, and thus, the brightness of all the colors in the subpixels is uneven enough that the display performance is affected.

Consequently, it is important to decrease the feedthrough voltage difference between the adjacent subpixels and to improve the display performance of the TFT LCD which adopts the MSHD driving circuit technology.

SUMMARY OF THE INVENTION

One objective of the present invention is to provide a pulse adjustment circuit. The pulse adjustment circuit is connected between a power supply and a gate driver. The power supply provides a power signal, while the pulse adjustment circuit comprises a first switch and a discharge unit. The first switch determines a timing of power signal transmission to the gate driver in response to a first control signal. The discharge unit determines a timing of discharging the power supply signal, which has been transmitted to the gate driver. The first switch and the discharge unit are turned on alternatively.

Another objective of the present invention is to provide a pulse adjustment circuit. The pulse adjustment circuit is connected between a power supply and a gate driver. The power supply provides a plurality of power signals with different voltages levels, while the pulse adjustment circuit comprises a signal generator and a selector. The signal generator generates a set of control signals. The selector determines a timing of power signal transmission to the gate driver in response to the set of control signals. The power signals transmitted to the gate driver determines an amplitude of input pulse signal, where the input pulse signal comprises a first pulse, second pulse, and third pulse. At least one of the amplitudes of the first pulse and the third pulse is larger than the amplitude of the second pulse.

The recited pulse adjustment circuit merely utilizes a pulse adjustment circuit to change a driving waveform inputted into the driving circuit. The feedthrough voltage difference between the two adjacent subpixels is then reduced.

Another objective of the present invention is to provide a liquid crystal display (LCD) apparatus. The LCD display apparatus comprises the aforementioned pulse adjustment circuit, a plurality of gate drivers, and a plurality of pulse adjustment circuits. The LCD apparatus comprises the aforementioned pulse adjustment circuit for adjusting the power signal provided from the power supply to the gate drivers first and then the feedthrough voltage difference between the even sub-pixels and the odd subpixels. The picture display quality of the LCD apparatus is then improved.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

The feedthrough voltage is calculated based on the following equation:

$$V_{feedthrough} = \frac{C_{GD}}{C_{GD} + C_{LC} + C_{st}} \Delta V,$$

where $C_{GD}$ is a stray capacitance between the gate and the drain of the TFT, $C_{LC}$ is a liquid crystal capacitance, and $C_{st}$ is a stay capacitance. $\Delta V$ is equal to $V-V_{GL}$, where $V_{GL}$ is the lowest level of the waveform of an activating signal, and V is a final voltage of the waveform of the activating signal. $V_{feedthrough}$ decreases as $\Delta V$ decreases, and thus the influence of the feedthrough voltage on the subpixels is reduced. Therefore, the present invention brings up the following embodiment according to this principle.

Figure 1A:
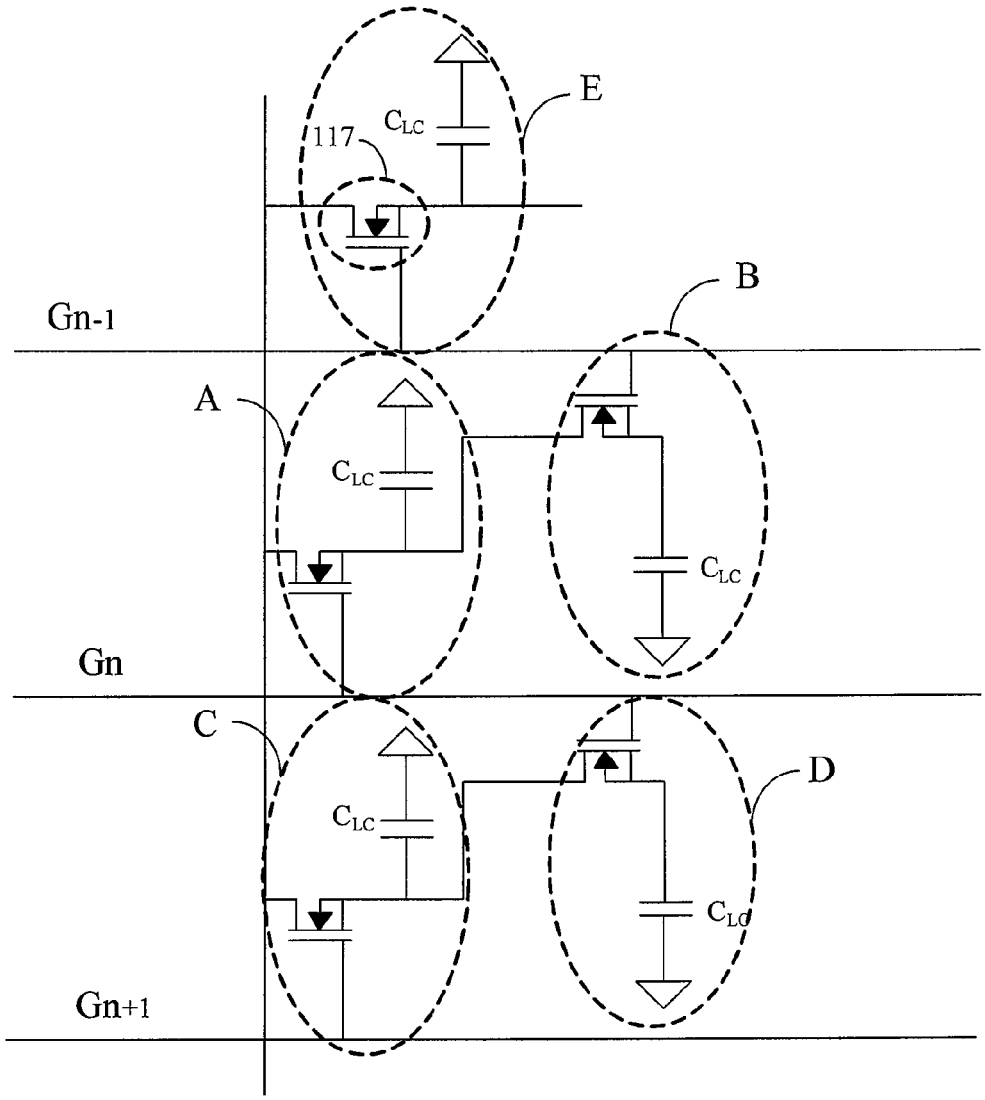
FIG. 1A (prior art)
FIG. 1A is a schematic diagram of a conventional MSHD driving circuit.
Figure 1B:
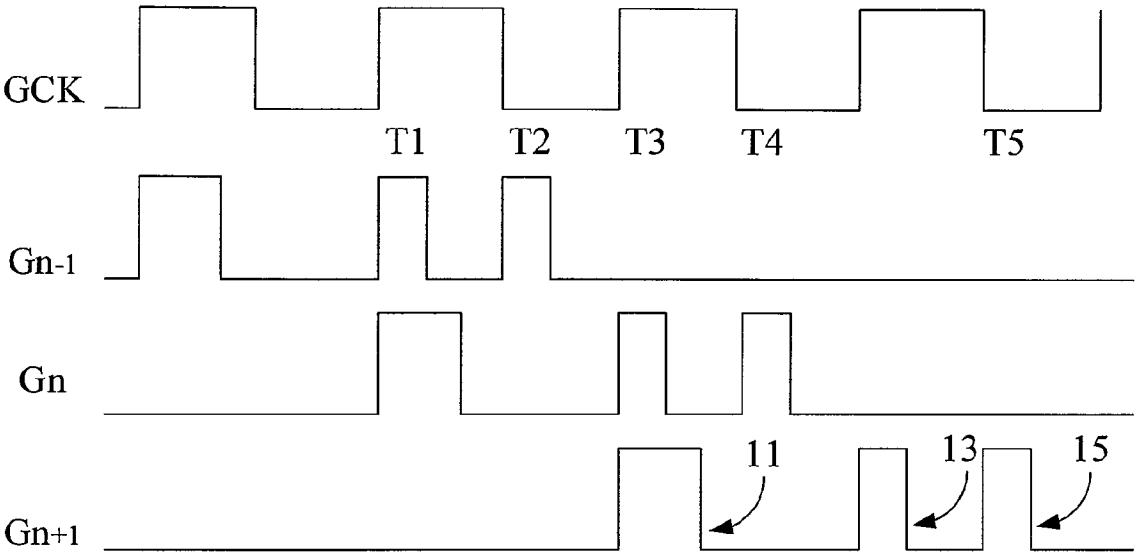
FIG. 1B (prior art)
FIG. 1B is a timing diagram of the conventional MSHD gate driving signal.
Figure 1C:
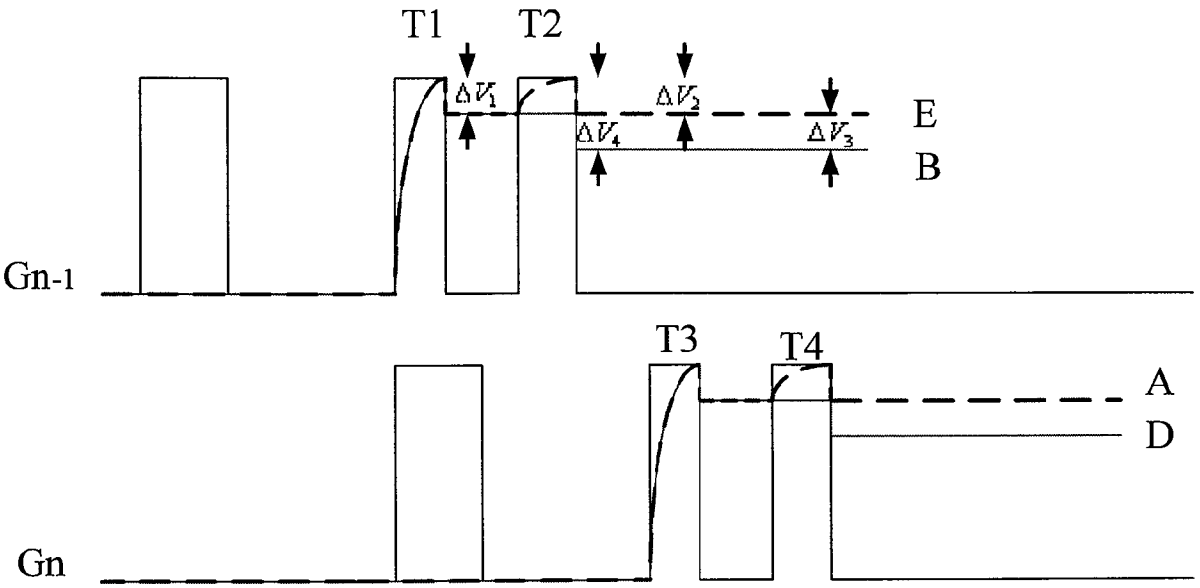
FIG. 1C (prior art)
FIG. 1C is a schematic diagram of the conventional MSHD pixel affected by a feedthrough voltage.
Figure 2:
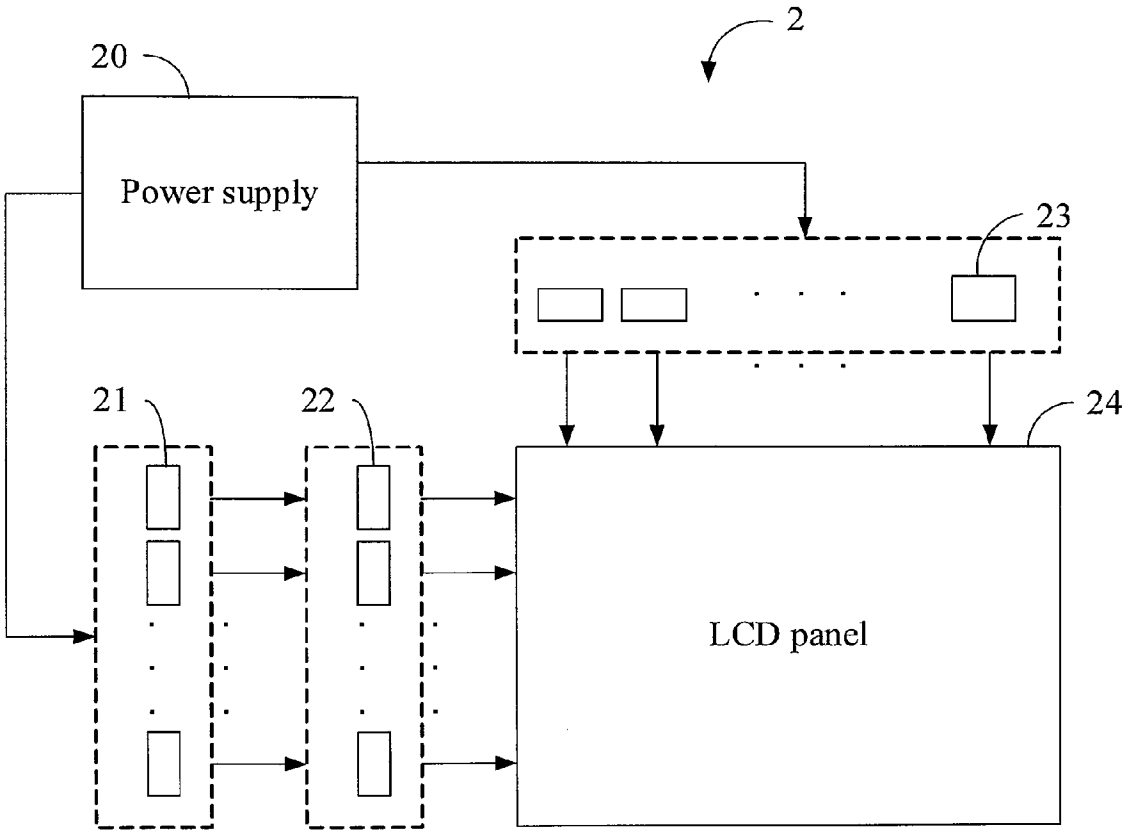
FIG. 2 is a schematic diagram of a first embodiment in accordance with the present invention.

The first embodiment of the present invention is an LCD apparatus 2, especially a TFT LCD, as shown in FIG. 2. The LCD apparatus 2 comprises a power supply 20, a plurality of pulse adjustment circuits 21, a plurality of gate drivers 22, a plurality of source drivers 23, and an LCD panel 24. The LCD apparatus 2 incorporates the MSHD technology and comprises fewer source drivers.

Figure 2A:
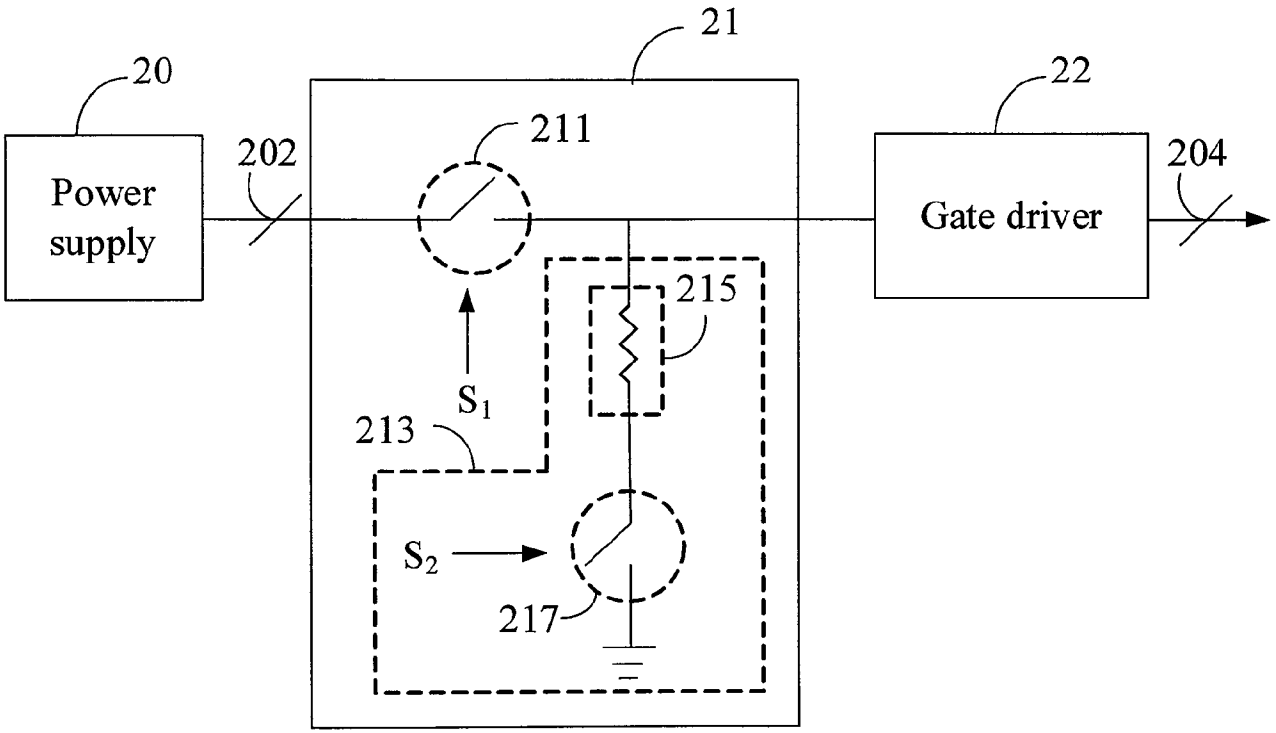
FIG. 2A is a pulse adjustment circuit schematic of the first embodiment in accordance with the present invention.

The details of the structural connections of the power supply 20, one pulse adjustment circuit, and one gate driver 22 are shown in FIG. 2A. The pulse adjustment circuit 21 is connected between the power supply 20 and the gate driver 22. Another end of the gate driver 22 is connected to one scan line of the active matrix driving circuit. The power supply 20 provides a power signal 202. The power signal 202 can be a direct current (DC) voltage signal in this embodiment. The pulse adjustment circuit 21 comprises a first switch 211 and a discharge unit 213. The discharge unit 213 comprises a resistance 215 and a second switch 217 placed in series with the resistance 215. One end of the second switch 217 is connected to the resistance 215 while the other end of the second switch 217 is grounded. The pulse adjustment circuit 21 adjusts the level of the power signal 202, and then the adjusted power signal 202 becomes a pulse 204 through the gate driver 22 and is transmitted to the scan line of the active matrix driving circuit.

Figure 2B:
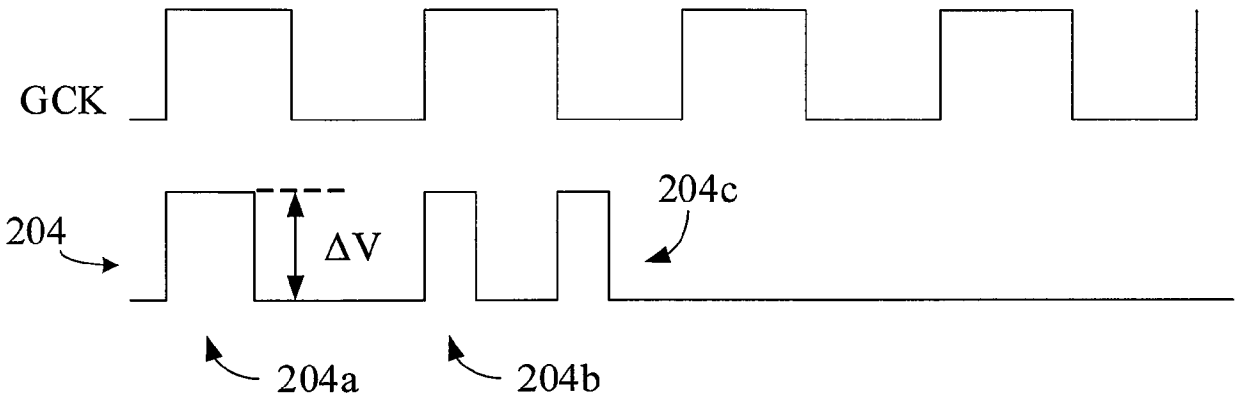
FIG. 2B is a timing diagram of an unadjusted gate driving signal of the first embodiment in accordance with the present invention.

The pulse 204 shown in FIG. 2B, inputted to the scan line, comprises a first pulse 204*a*, a second pulse 204*b*, and a third pulse 204*c*, which are repeated in order. The first pulse 204*a* has a longer duty cycle while the second pulse 204*b* and the third pulse 204*c* have a shorter duty cycle.

The timing of transmitting the power signal 202 to the gate driver 22 is determined in response to a first control signal $S_1$ by the first switch 211. When the first control signal $S_1$ is at the high level, the first switch 211 is turned on and the power signal 202 is then transmitted to the gate driver 204 to form the pulse 204. The discharge timing of the power signal 202 which is transmitted to the gate driver 22 is determined according to a second control signal $S_2$ by the second switch 217. When the second control signal $S_2$ is at the high level, the second switch 217 is turned on. So, the power signal 202 transmitted to the gate driver 22 is discharged via the grounded resistance 215 and the power signal 202 is changed so that the power signal 202 becomes a chamfered signal. The pulse 204 formed by the gate driver 22 is adjusted to a chamfered pulse. In this embodiment, the first control signal and the second control signal are reversed in phase so that the first switch 211 and the second switch 217 are turned on alternatively. Furthermore, the duty cycle of the first control signal $S_1$ is much longer than that of the second control signal $S_2$.

Figure 2C:
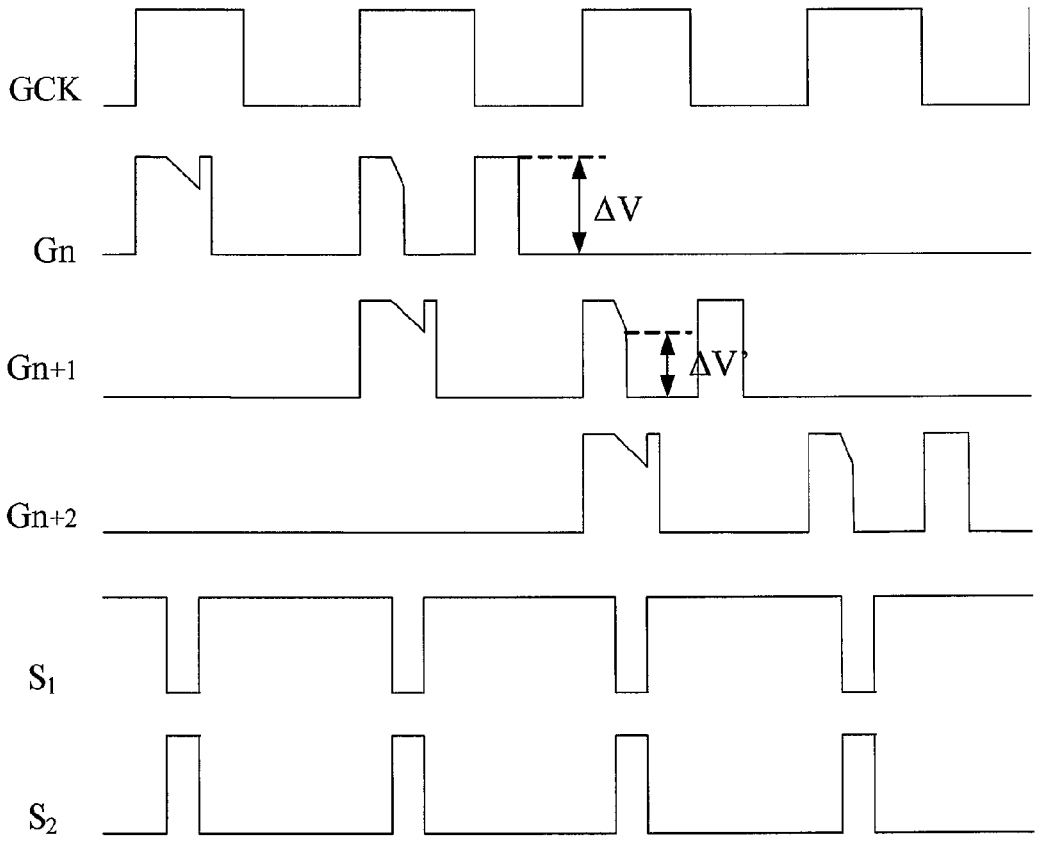
FIG. 2C is a timing diagram of a plurality of adjusted gate driving signals of the first embodiment in accordance with the present invention.

For each of the scan lines of the driving circuit, the front end of each scan line connects to the power supply 20, a pulse adjustment circuit 21, and a gate driver 22. FIG. 2C shows the timing diagram of the pulses 204 inputted to the scan lines $G_n$, $G_{n+1}$, and $G_{n+2}$. Referring to this diagram, the high level of the second control signal $S_2$ corresponds the ends of the first pulse 204*a* and the second pulse 204*b* of the pulse 204 inputted to each scan line. Since both the first pulse 204*a* and second pulse 204*b* are used to enable the data voltages that are used to charge to the even subpixels, the final charged voltages of the even subpixels are decreased by the influence of the second control signal $S_2$. That is, the level of the power signal 202 is changed during discharge, and the pulse 204 formed by the gate driver 22 becomes a chamfered signal. Therefore, the feedthrough voltage is also decreased when $\Delta V$ is decreased to $\Delta V'$. Furthermore, the resistance value can be adjusted to change the degree of the feedthrough voltage reduction.

Figure 2D:
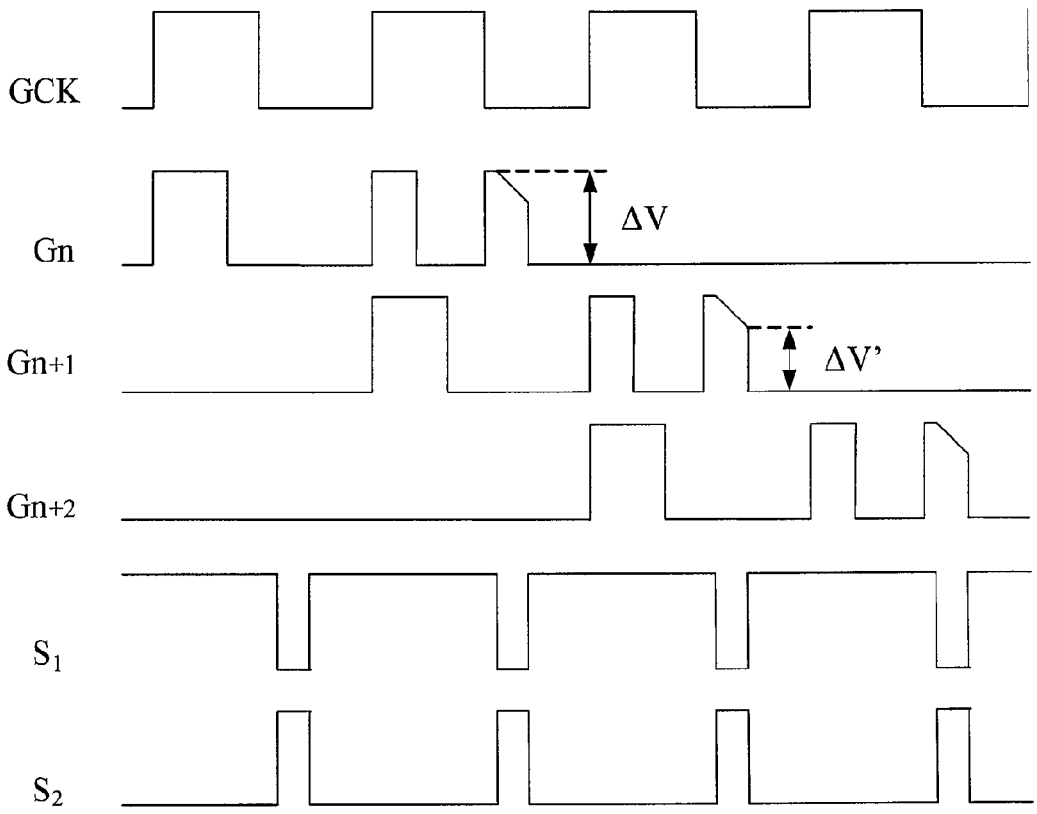
FIG. 2D is a timing diagram of a plurality of adjusted gate driving signals of another aspect of the first embodiment in accordance with the present invention.

The first switch 211 and the second switch 217 of the first embodiment may have another aspect in order to modify the feedthrough voltage of the odd subpixels. The timing diagram of the pulse 204 inputted to the scan lines $G_n$, $G_{n+1}$, and $G_{n+2}$ is shown in FIG. 2D. The high level of the second control signal $S_2$ corresponds to the end of the third pulse 204*c* of each pulse of each scan line in this aspect. Since the third pulse 204*c* is used to enable the data voltage charged into the odd subpixels, the final voltage charged into the odd pixels are decreased by the influence of the second control signal $S_2$ of the pulse adjustment circuit 21 thereby. That is, the level of the power signal 202 is changed during discharge, and the pulse 204 formed by the gate driver 22 becomes a chamfer pulse. Therefore, the feedthrough voltage of the odd subpixels decreases with decreasing $\Delta V$ to $\Delta V'$.

Figure 2E:
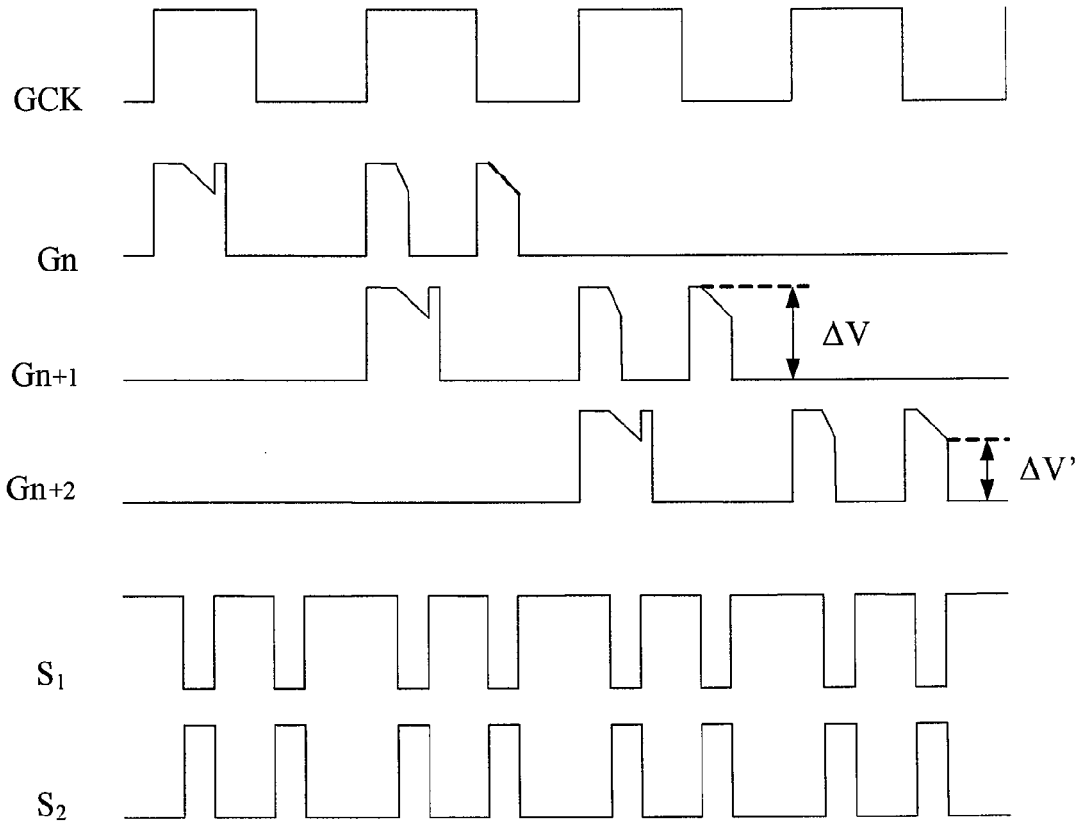
FIG. 2E is a timing diagram of a plurality of adjusted gate driving signals of a further aspect of the first embodiment in accordance with the present invention.

In the first embodiment, there is another way to turn the first switch 211 and the second switch 217 off to adjust the feedthrough voltage of the odd subpixels and the even subpixels at the same time. The timing diagram of the pulses, to be inputted to the scan lines $G_n$, $G_{n+1}$, and $G_{n+2}$, after the adjustment are shown in FIG. 2E. The high level of the second control signal $S_2$ corresponds to the ends of charging of the odd and even subpixels, i.e. the ends of the first pulse 204*a*, the second pulse 204*b*, and the third pulse 204*c* of each pulse 204 inputted to each scan line, in this embodiment. Because the first pulse 204*a* and the second pulse 204*b* are configured to enable the data voltage which is going to be charged in the even subpixels and the third pulse 204*c* is configured to enable the data voltage which is going to be charted into the odd subpixels, the final voltage charged in the even subpixels and the odd subpixels is decreased in response to the second control signal $S_2$ thereby. That is, the level of the power signal 202 is changed during discharge, and the pulse 204 formed by the gate driver 22 becomes a chamfer pulse. Therefore, the feedthrough voltage of the odd subpixels decreases with decreasing $\Delta V$ to $\Delta V'$.

Referring to the aforementioned equation, $V_{feedthrough}$ increases with the increase of $\Delta V$. Since the odd subpixels are turned on with only one TFT but the even subpixels are turned on with two TFTs, the display performance of the even subpixels is worse than that of the odd subpixels. Hence, the display performance of the even subpixels can be improved by decreasing the feedthrough voltage of the even subpixels by decreasing the $\Delta V$ between the first pulse and the second pulse. Alternatively, the display performance of the odd subpixels may be decreased by increasing the feedthrough voltage of the odd subpixels by increasing the $\Delta V$ of the third pulse and the second pulse. Then, the feedthrough voltage difference between the two adjacent subpixels decreases to improve the display performance of the LCD.

Figure 3A:
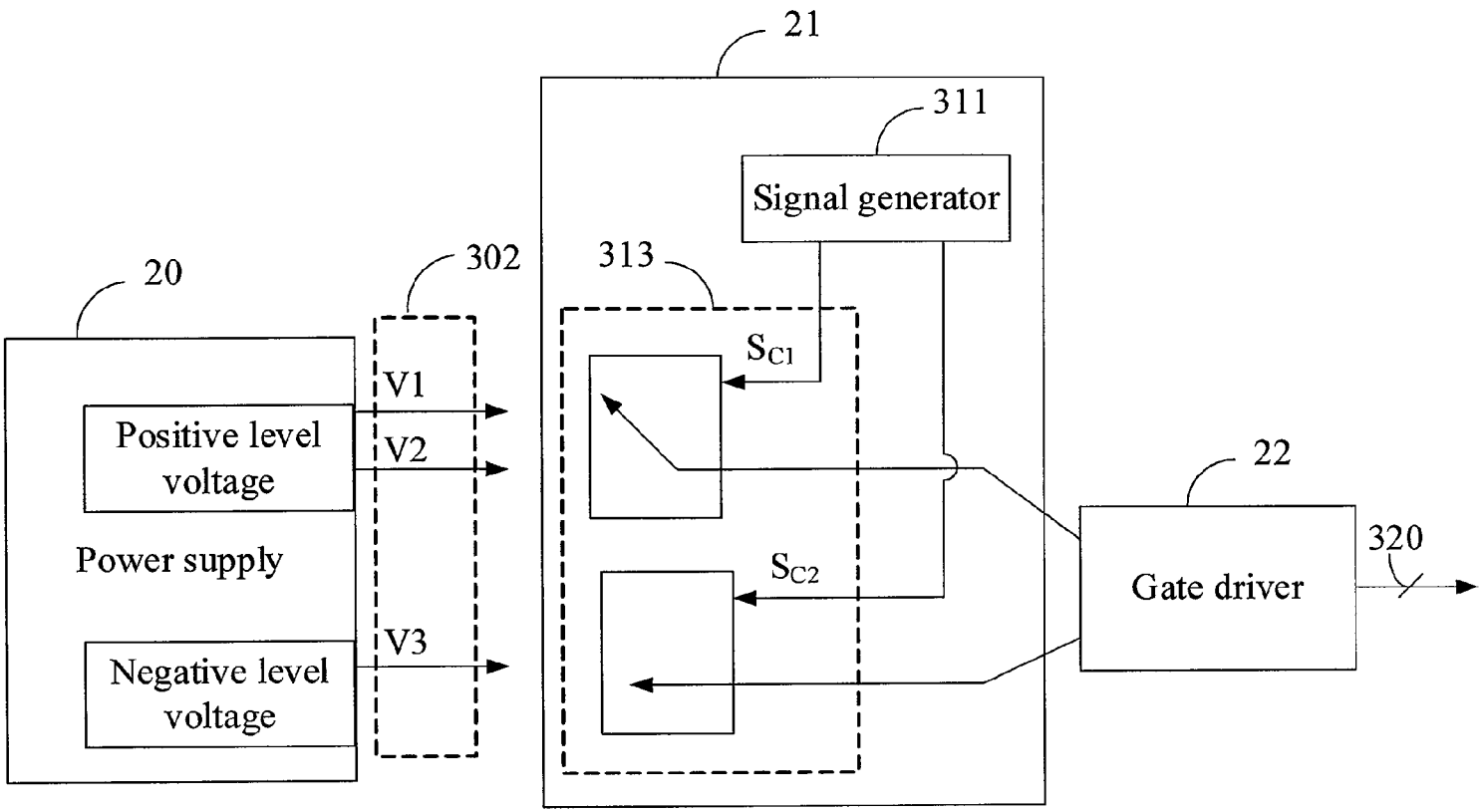
FIG. 3A is a pulse adjustment circuit schematic of the second embodiment in accordance with the present invention.

The second embodiment of the present invention is also an LCD apparatus 2 as shown in FIG. 2. The details of the structural connection of the power supply 20, a pulse adjustment circuit, and a gate driver 22 are shown in FIG. 3A. The pulse adjustment circuit 21 is connected between the power supply 20 and the gate driver 22. Another end of the gate driver 22 is connected to one scan line of the active matrix driving circuit. The power supply 20 provides a plurality of power signals 302. These power signals 302 have different voltage levels. The first positive level voltage signal V1, second positive level voltage signal V2, and negative level voltage signal V3, wherein V1 is 25 volts, V2 is 18 volts, and V3 is −6 volts.

The pulse adjustment circuit 21 comprises a signal generator 311 and a selector 313. The signal generator 311 generates a set of control signals $S_{C1}$ and $S_{C2}$. The selector 313 determines a timing of transmitting which of the power signals 302 to the gate driver in response to the set of control signals $S_{C1}$ and $S_{C2}$. The control signal $S_{C1}$ is configured to determine the timing of transmitting which of the positive level voltage signal V1 and V2 of the determined power signals 302 to the gate driver 22, and the control signal $S_{C2}$ is configured to determine a timing of transmitting the negative level voltage signal V3 of the determined power signals 302 to the gate driver 22.

The power signals 302 selected by the selector 313 are transmitted to the gate driver 22 to form an input pulse signal 320. The positive level voltage of the input pulse signal 320 is selected from the first positive level voltage signal V1 and the second positive level voltage signal V2, while the negative level voltage of the input pulse signal 320 is the first negative level voltage signal V3. The input pulse signals 320 inputted to each scan line comprise a first pulse, second pulse, and third pulse, and the amplitude of the third pulse is larger than those of the first pulse and the second pulse. Then, the input pulse signal 320 is transmitted to the scan line of the active matrix driving circuit via the gate driver 22.

Figure 3B:
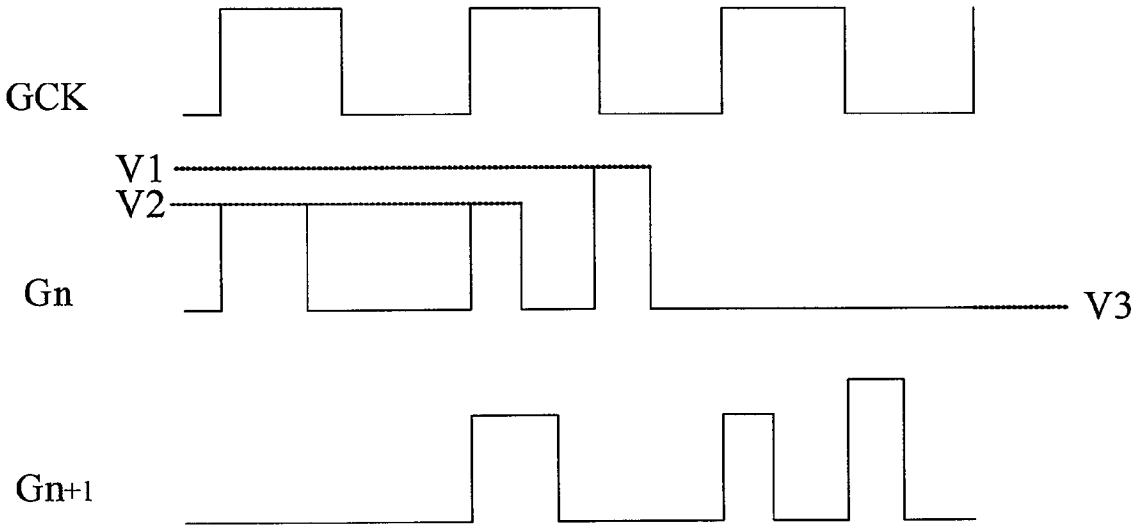
FIG. 3B is a schematic diagram of the second embodiment in accordance with the present invention.

The timing diagram of the input pulse signals 320 inputted to the scan lines $G_n$, and $G_{n-1}$, are shown in FIG. 3B. Referring to this figure, the voltage level of the first positive level voltage signal V1 is higher than that of the second positive level voltage signal V2. Thus, the control signal $S_{c1}$ controls the selector 313 to transmit the second positive level voltage signal V2 to the gate driver 22 when generating the first pulse and the second pulse. The control signal $S_{C1}$ controls the selector 313 to transmit the first positive level voltage signal V1 to the gate driver 22 when generating the third pulse. The amplitude of the third pulse is larger than that of the first or second pulse, and thus ΔV (18−(−6)=24) of the first pulse or the second pulse is smaller than ΔV (25−(−6)=31) of the third pulse. Since the third pulse is configured to enable the data voltage that is going to be charged in the odd subpixels and since the first and second pulses are configured to enable the data voltage that is going to be charted into the even subpixels, the feedthrough voltage difference between the even subpixels and the odd subpixels are decreased. Thus, the display performance of the even subpixels is similar to that of the odd subpixels.

Figure 4A:
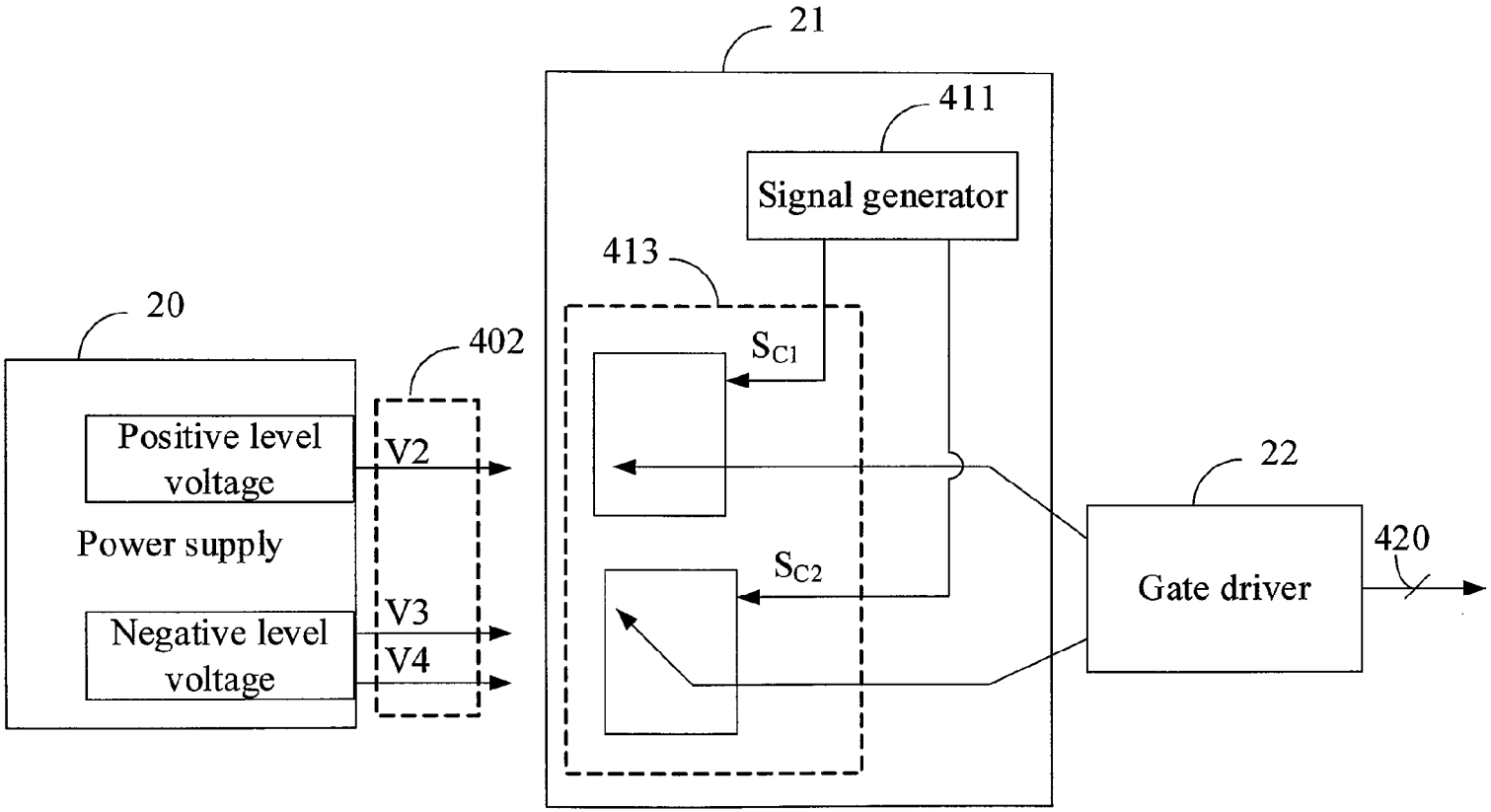
FIG. 4A is a pulse adjustment circuit schematic of the third embodiment in accordance with the present invention.

The third embodiment of the present invention is also the LCD apparatus 2 as shown in FIG. 2. The details of the structural connection of the power supply 20, a pulse adjustment circuit, and a gate driver 22 are shown in FIG. 4A. The power supply 20 provides three kinds of direct current voltage signals, which are a second positive level voltage signal V2, a first negative level voltage signal V3, and a second negative level voltage signal V4, wherein V2 is 18 volts, V3 is −6 volts, and V4 is −10 volts.

The pulse adjustment circuit 21 also comprises a signal generator 411 and a selector 413. The signal generator 411 generates a set of control signals $S_{C1}$ and $S_{C2}$. The selector 413 determines a timing to transmit which of the power signals 302 to the gate driver 22 in response to the set of control signals. The control signal $S_{C1}$ is configured to determine the timing of transmitting the positive level voltage signal V2 of the determined power signals 402 to the gate driver 22, while the control signal $S_{C2}$ is configured to determine a timing of transmitting the negative level voltage signals V3 and V4 of the determined power signals 402 to the gate driver 22.

The power signals 402 selected by the selector 413 are transmitted to the gate driver 22 to form an input pulse signal 420. The positive level voltage of the input pulse signal 420 is the second positive level voltage signal V2, while the negative level voltage of the input pulse signal 420 is selected from the first negative level voltage signal V3 and the second negative level voltage signal V4. The input pulse signals 420 inputted to each scan line comprise a first pulse, a second pulse, and a third pulse, wherein the amplitude of the third pulse is larger than that of the first pulse and the second pulse. Then, the input pulse signal 420 is transmitted to the scan line of the active matrix driving circuit via the gate driver 22.

Figure 4B:
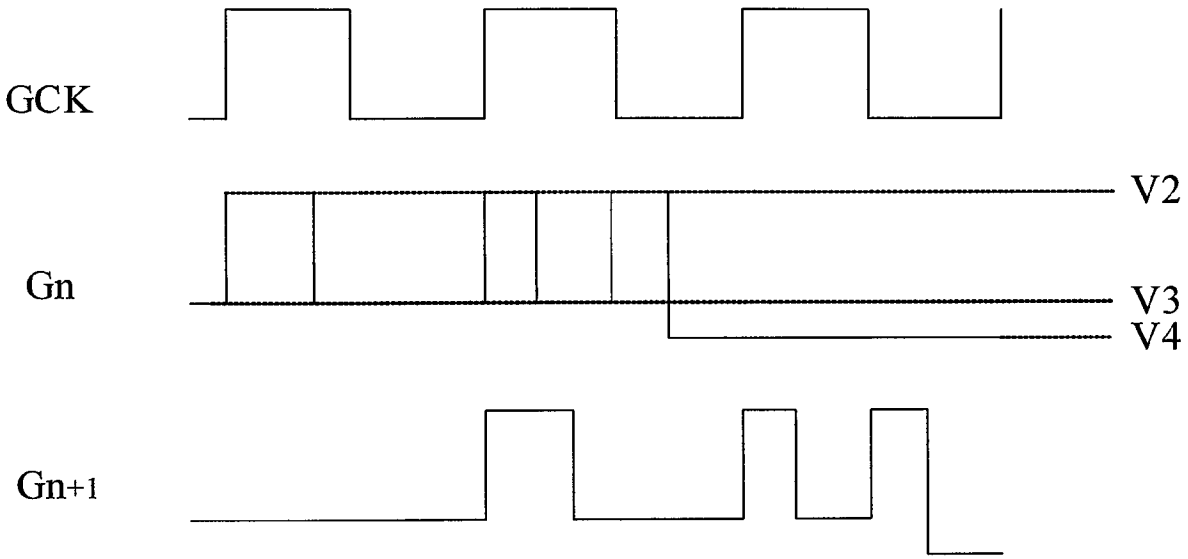
FIG. 4B is a schematic diagram of the third embodiment in accordance with the present invention.

The timing diagram of the input pulse signals 420 inputted to the scan lines G, and $G_n$ and $G_{n+1}$ are shown in FIG. 4B. In this figure, the voltage level of the first negative level voltage signal V3 is higher than that of the second negative level voltage signal V4. The control signal $S_{C2}$ controls the selector 413 to transmit the first negative level voltage signal V3 to the gate driver 22 when generating the first pulse and the second pulse. The control signal $S_{C2}$ controls the selector 413 to transmit the second negative level voltage signal V4 to the gate driver 22 when generating the third pulse. The amplitude of the third pulse is larger than that of the first or second pulse, an thus the ΔV (18−(−6)=24) of the first pulse or the second pulse is smaller than the ΔV (18−(−10)=28) of the third pulse. Since the third pulse is configured to enable the data voltage that is going to be charged in the odd subpixels and since the first pulse and the second pulse are configured to enable the data voltage which is going to be charted into the even subpixels, the feedthrough voltage difference between the even and odd subpixels are decreased. Therefore, the display performance of the even subpixels is similar to that of the odd subpixels.

Figure 5A:
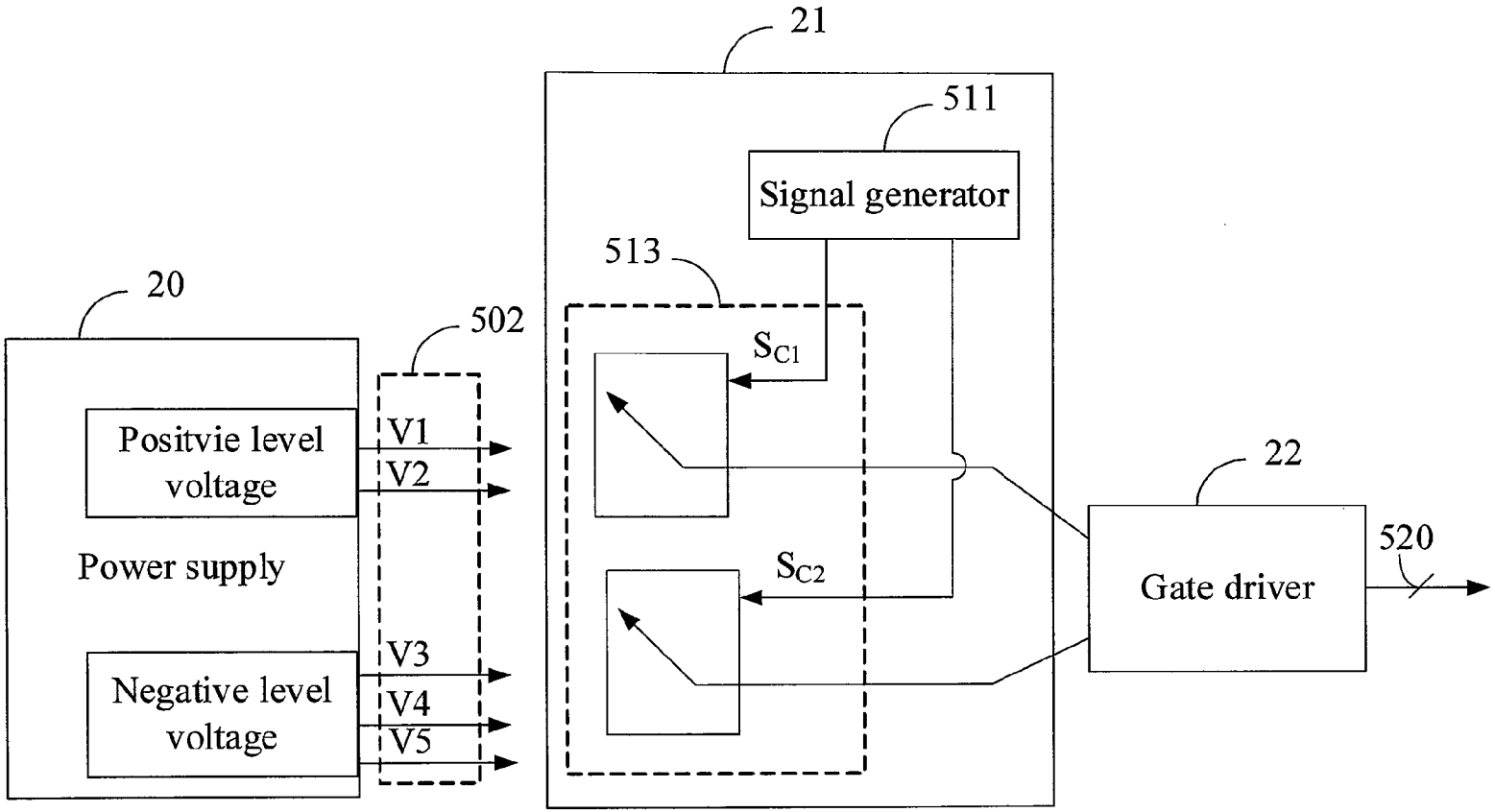
FIG. 5A is a pulse adjustment circuit schematic of the fourth embodiment in accordance with the present invention.

The fourth embodiment of the present invention is also an LCD apparatus 2 as shown in FIG. 2. The details of the structural connection of the power supply 20, a pulse adjustment circuit, and a gate driver 22 is shown in FIG. 5A. The power supply 20 provides five kinds of direct current voltage signals, which are a first positive level voltage signal V1, a second positive level voltage signal V2, a first negative level voltage signal V3, a second negative level voltage signal V4, and a third negative level voltage signal V5, wherein V1 is 25 volts, V2 is 18 volts, V3 is −6 volts, V4 is −10 volts, and V5 is 0 volts.

The pulse adjustment circuit 21 comprises a signal generator 511 and a selector 513. The signal generator 511 generates a set of control signals $S_{C1}$ and $S_{C2}$. The selector 513 determines a timing of transmitting the determined power signals 302 to the gate driver 22 in response to this set of control signals. The control signal $S_{C1}$ is configured to determine the timing of transmitting the positive level voltage signals V1 and V2 of the determined power signals 302 to the gate driver 22, and the control signal $S_{C2}$ is configured to determine a timing of transmitting the negative level voltage signals V3, V4, and V5 of the determined power signals 302 to the gate driver 22.

The power signals 502 selected by the selector 513 are transmitted to the gate driver 22 to form an input pulse signal 520. The positive level voltage of the input pulse signal 520 is selected from the first positive level voltage signal V1 and the second positive level voltage signal V2, while the negative level voltage of the input pulse signal 320 is selected from the first negative level voltage signal V3, the second negative level voltage signal V4, and the third negative level voltage signal V5. The input pulse signals 520 inputted to each scan line comprise a first pulse, a second pulse, and a third pulse. The amplitude of the third pulse is larger than that of the first pulse and the second pulse. Then, the input pulse signal 520 is transmitted to the scan line of the active matrix driving circuit via the gate driver 22.

Figure 5B:
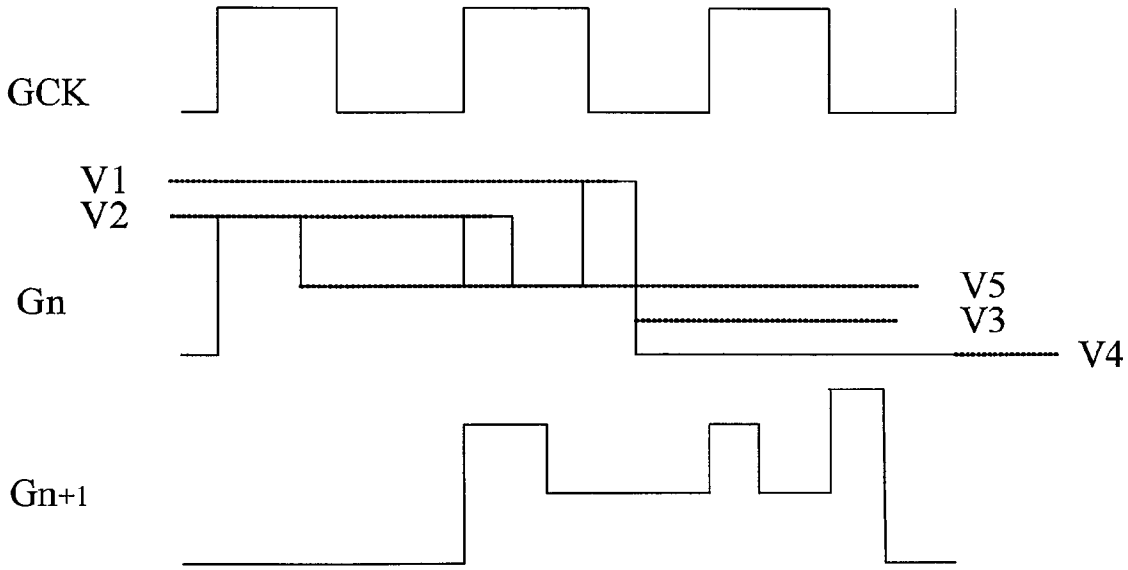
FIG. 5B is a schematic diagram of the fourth embodiment in accordance with the present invention.

The timing diagram of the input pulse signals 520 inputted to the scan lines $G_n$ and $G_{n+1}$ are shown in FIG. 5B. In this figure, the voltage level of the first positive level voltage signal V1 is higher than that of the second positive level voltage signal V2. The control signal $S_{C1}$ controls the selector 513 to transmit the second positive level voltage signal V2 to the gate driver 22 when generating the first pulse and the second pulse. The control signal $S_{C1}$ controls the selector 513 to transmit the first positive level voltage signal V1 to the gate driver 22 when generating the third pulse. The voltage level of the second negative level voltage signal V4 is lower than that of the third negative level voltage signal V5, so the control signal $S_{C2}$ controls the selector 513 to transmit the third positive level voltage signal V5 to the gate driver 22 when generating the first pulse and the second pulse. The control signal $S_{C2}$ controls the selector 513 to transmit the second negative level voltage signal V4 to the gate driver 22 when generating the third pulse. The amplitude of the third pulse is larger than that of the first or second pulse, and thus the ΔV (18−0=18) of the first pulse or the second pulse is smaller than the ΔV (25−(−10)=35) of the third pulse. Since the third pulse is configured to enable the data voltage that is going to be charged in the odd subpixels and since the first and second pulses are configured to enable the data voltage that is going to be charted into the even subpixels, the feedthrough voltage difference between the even and odd subpixels is then decreased. Therefore, the display performance of the even subpixels is similar to that of the odd subpixels.

The present invention adjusts the pulse provided from the power supply to the gate driver in advance. The feedthrough voltage differences of the even subpixels and the odd subpixels are decreased to improve the display performance of the LCD apparatus.

The above disclosure is related to the detailed technical contents and inventive features thereof. People having ordinary skills in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the appended claims.

What is claimed is:

1. A pulse adjustment circuit of a liquid crystal display (LCD), connected between a power supply and a gate driver of the LCD, the power supply providing a plurality of power signals, the power signals having different voltages levels, the pulse adjustment circuit comprising:

a signal generator for generating a set of control signals; and a selector for determining a timing of transmitting the power signals to the gate driver in response to the set of control signals;

wherein the power signals transmitted to the gate driver generates a set of input pulse signals every two consecutive clock cycles, determines amplitudes of the set of input pulse signals, and the set of input pulse signals comprises a first pulse, a second pulse, and a third pulse;

wherein said first pulse, with a first amplitude and a first duration, beginning with a first clock cycle's rising edge;

wherein said second pulse, with a second amplitude and a second duration, beginning with a second clock cycle's rising edge;

wherein said third pulse, with a third amplitude, beginning with said second clock cycle's falling edge; and wherein said first amplitude is a positive voltage level, said first amplitude is greater than said second amplitude, and said first duration is twice said second duration, and said first pulse, said second pulse, said third pulse are asserted to a first scan line in a consecutive sequence, and the first scan line only consists said first pulse, said second pulse, and said third pulse during said first clock cycle and said second clock cycle for each frame.

2. The pulse adjustment circuit as claimed in claim 1, wherein the power signal comprises a first negative power signal and a second negative power signal, a voltage level of the first negative power signal is lower than a voltage level of the second negative power signal, the set of control signals control the selector to transmit the first negative power signal to the gate driver while generating the first pulse, the set of control signals control the selector to transmit the second negative power signal to the gate driver while generating the second pulse, and an amplitude of the first pulse is larger than an amplitude of the second pulse.

3. The pulse adjustment circuit as claimed in claim 1, wherein the power signal comprises a first negative power signal and a second negative power signal, a voltage level of the first negative power signal is higher than a voltage level of the second negative power signal, the set of control signals control the selector to transmit the first negative power signal to the gate driver while generating the second pulse, the set of control signals control the selector to transmit the second negative power signal to the gate driver while generating the third pulse, and the amplitude of an third pulse is larger than an amplitude of the second pulse.

4. The pulse adjustment circuit as claimed in claim 1, wherein the power signal comprises a first positive power signal and a second positive power signal, a voltage level of the first positive power signal is lower than a voltage level of the second positive power signal, the set of control signals control the selector to transmit the first positive power signal to the gate driver while generating the second pulse, the set of control signals control the selector to transmit the second positive power signal to the gate driver while generating the third pulse, and an amplitude of the third pulse is larger than an amplitude of the second pulse.

5. The pulse adjustment circuit as claimed in claim 1, wherein each of the first pulse, the second pulse and the third pulse has a rising section, a high-level section and a falling section.

6. The pulse adjustment circuit as claimed in claim 1, wherein said LCD comprising:

a multi-switch half source driving (MSHD) circuit comprising a first scan line, a second scan line, a data line, a first subpixel, a second subpixel, a gate driver, and a drain driver;

wherein said first scan line and second scan line are electrically connected to said gate driver, said data line is electrically connected to said drain driver, said first subpixel and second subpixel are disposed between said first scan line and said second scan line, said first subpixel's gate is electrically connected to said second scan line, said second subpixel's gate is electrically connected to said first scan line, said first subpixel's drain is electrically connected to said data line, said second subpixel's drain is electrically connected to a source of said first subpixel, and said gate driver and said drain driver charge said first subpixel and said second subpixel via said first scan line, said second scan line, and said data line.

7. A liquid crystal display (LCD), comprising:

a power supply being configured to provide a plurality of power signals, wherein the power signals having different voltages levels;

a gate driver electrically connected to a first scan line and a second scan line;

a drain driver electrically connected to a data line;

a first subpixel;

a second subpixel; and a pulse adjustment circuit connected between the power supply and the gate driver, comprising:

a signal generator for generating a set of control signals; and a selector for determining a timing of transmitting the power signals to the gate driver in response to the set of control signals;

wherein the power signals transmitted to the gate driver generates a set of input pulse signals every two consecutive clock cycles, and determines amplitudes of the set of the input pulse signals, and the set of the input pulse signals comprises a first pulse, a second pulse, and a third pulse;

wherein said first pulse, with a first amplitude and a first duration, beginning with a first clock cycle's rising edge; and wherein said second pulse, with a second amplitude and a second duration, beginning with a second clock cycle's rising edge; and wherein said third pulse, with a third amplitude, and beginning with said second clock cycle's falling edge; and wherein said first amplitude is a positive voltage level, said first amplitude is greater than said second amplitude, and said first duration is twice said second duration, and said first pulse, said second pulse, said third pulse are asserted to a first scan line in a consecutive sequence, and the first scan line only consists said first pulse, said second pulse, and said third pulse during said first clock cycle and said second clock cycle for each frame.

8. The liquid crystal display as claimed in claim 7, wherein the power signal comprises a first negative power signal and a second negative power signal, a voltage level of the first negative power signal is lower than a voltage level of the second negative power signal, the set of control signals control the selector to transmit the first negative power signal to the gate driver while generating the first pulse, the set of control signals control the selector to transmit the second negative power signal to the gate driver while generating the second pulse, and an amplitude of the first pulse is larger than an amplitude of the second pulse.

9. The liquid crystal display as claimed in claim 7, wherein the power signal comprises a first negative power signal and a second negative power signal, a voltage level of the first negative power signal is higher than a voltage level of the second negative power signal, the set of control signals control the selector to transmit the first negative power signal to the gate driver while generating the second pulse, the set of control signals control the selector to transmit the second negative power signal to the gate driver while generating the third pulse, and the amplitude of an third pulse is larger than an amplitude of the second pulse.

10. The liquid crystal display as claimed in claim 7, wherein the power signal comprises a first positive power signal and a second positive power signal, a voltage level of the first positive power signal is lower than a voltage level of the second positive power signal, the set of control signals control the selector to transmit the first positive power signal to the gate driver while generating the second pulse, the set of control signals control the selector to transmit the second positive power signal to the gate driver while generating the third pulse, and an amplitude of the third pulse is larger than an amplitude of the second pulse.

11. The liquid crystal display as claimed in claim 7, wherein each of the first pulse, the second pulse and the third pulse has a rising section, a high-level section and a falling section.

12. The LCD as claimed in claim 7, wherein said first subpixel and said second subpixel are disposed in a multi-switch half source driving (MSHD) circuit comprising:

said first subpixel and said second subpixel disposed between said first scan line and said second scan line;

said first scan line and said second scan line electrically connected to said gate driver;

said data line is electrically connected to said drain driver;

said first subpixel's gate is electrically connected to said second scan line;

said second subpixel's gate is electrically connected to said first scan line;

said first subpixel's drain is electrically connected to said data line;

said second subpixel's drain is electrically connected to a source of said first subpixel;

wherein said gate driver and said drain driver charge said first subpixel and said second subpixel via said first scan line, said second scan line, and said data line.

13. The pulse adjustment circuit as claimed in claim 7, wherein said first amplitude is a positive voltage level, said first amplitude is greater than said second amplitude, and said first duration is twice said second duration, and said first pulse, said second pulse, and said third pulse are asserted to a first scan line in sequence.

* * * * *